US007422307B2

(12) United States Patent
Yogi et al.

(10) Patent No.: US 7,422,307 B2
(45) Date of Patent: Sep. 9, 2008

(54) DROPLET FORMING METHOD FOR MIXED LIQUID AND DROPLET FORMING DEVICE, AND INK JET PRINTING METHOD AND DEVICE, AND INK JET PRINTING ELECTRODE-CARRYING NOZZLE

(75) Inventors: Osamu Yogi, Hamamatsu (JP); Tomonori Kawakami, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 81 days.

(21) Appl. No.: 10/529,060

(22) PCT Filed: Aug. 20, 2003

(86) PCT No.: PCT/JP03/10528

§ 371 (c)(1),
(2), (4) Date: Mar. 24, 2005

(87) PCT Pub. No.: WO2004/030914

PCT Pub. Date: Apr. 15, 2004

(65) Prior Publication Data

US 2006/0038860 A1 Feb. 23, 2006

(30) Foreign Application Priority Data

Sep. 30, 2002 (JP) ..... 2002-287267

(51) Int. Cl.
*B41J 2/015* (2006.01)

(52) U.S. Cl. ..... 347/21

(58) Field of Classification Search ..... 347/10, 347/20, 21, 43, 51, 55, 74, 76
See application file for complete search history.

(56) References Cited

U.S. PATENT DOCUMENTS 3,060,429 A 10/1962 Winston (Continued)

FOREIGN PATENT DOCUMENTS

DE 29 49 808 7/1980

(Continued)

OTHER PUBLICATIONS

Proceedings of 2002 Annual Meeting of the Institute of Electrostatics Japan, Aug. 29-30, 2002, pp. 151-154.

(Continued)

*Primary Examiner*—Anh T. N. Vo
(74) *Attorney, Agent, or Firm*—Drinker Biddle & Reath LLP

(57) ABSTRACT

The invention provides an ink jet printing method for printing a color image on a printing object by using a plurality of inks, wherein ink nozzles 9*a* through 9*d* which house the plurality of inks, respectively, and a dilution nozzle 8 which houses a dilute solution that can dilute the inks are used, the ink is discharged from the ink nozzle 9*a* by an electrostatic sucking force to form a droplet L on a printing object 4, and then the ink is discharged from the ink nozzle 9*b* by an electrostatic sucking force and the inks are mixed within the droplet L to form a droplet in an arbitrary additive color. In this case, primary color inks can be accurately mixed within the droplet L.

13 Claims, 7 Drawing Sheets

U.S. PATENT DOCUMENTS

| | | | | | |
|---|---|---|---|---|---|
| 4,160,257 | A | * | 7/1979 | Carrish | 347/127 |
| 4,263,601 | A | | 4/1981 | Nishimura et al. | 346/1.1 |
| 4,346,387 | A | * | 8/1982 | Hertz | 347/75 |
| 4,621,268 | A | * | 11/1986 | Keeling et al. | 347/82 |
| 4,992,807 | A | * | 2/1991 | Thomson | 347/128 |
| 5,014,076 | A | * | 5/1991 | Caley et al. | 347/126 |
| 5,528,046 | A | | 6/1996 | Ishikawa | 250/461.2 |
| 5,560,543 | A | | 10/1996 | Smith et al. | 239/102.2 |
| 5,813,614 | A | | 9/1998 | Coffee | 239/690 |
| 5,965,446 | A | | 10/1999 | Ishikawa | 436/5 |
| 6,007,630 | A | * | 12/1999 | Pletcher et al. | 118/624 |
| 6,200,013 | B1 | | 3/2001 | Takeuchi et al. | 366/162.4 |
| 6,242,266 | B1 | | 6/2001 | Schleifer et al. | 436/518 |
| 6,252,129 | B1 | | 6/2001 | Coffee | 602/42 |
| 6,623,113 | B2 | * | 9/2003 | Yamada et al. | 347/77 |
| 6,764,720 | B2 | * | 7/2004 | Pui et al. | 427/479 |
| 6,796,632 | B2 | * | 9/2004 | Yamada et al. | 347/22 |
| 6,811,090 | B2 | * | 11/2004 | Yogi et al. | 239/4 |
| 2002/0007869 | A1 | | 1/2002 | Pui et al. | |
| 2004/0182948 | A1 | | 9/2004 | Yogi et al. | |

FOREIGN PATENT DOCUMENTS

| | | |
|---|---|---|
| EP | 0 673 895 | 9/1995 |
| EP | 0 956 968 | 11/1999 |
| EP | 1 093 924 | 4/2001 |
| EP | 1 205 252 | 5/2002 |
| EP | 1 445 016 | 8/2004 |
| JP | 53-153979 | 12/1978 |
| JP | 54-51838 | 4/1979 |
| JP | 60-090853 | 5/1985 |
| JP | 62-143844 | 6/1987 |
| JP | 63-129034 | 6/1988 |
| JP | 63-129035 | 6/1988 |
| JP | 64-42140 | 3/1989 |
| JP | 4-61946 | 4/1989 |
| JP | 4-039045 | 2/1992 |
| JP | 06-148076 | 5/1994 |
| JP | 6-258328 | 9/1994 |
| JP | 8-066652 | 3/1996 |
| JP | 08-207318 | 8/1996 |
| JP | 10-185782 | 10/1996 |
| JP | 09-272207 | * 10/1997 |
| JP | 11-198383 | 7/1999 |
| JP | 11-300975 | 11/1999 |
| JP | 2000-62165 | 2/2000 |
| JP | 2000-111477 | 4/2000 |
| JP | 2000-185403 | 7/2000 |
| JP | 2000-313162 | 11/2000 |
| JP | 2000-329771 | 11/2000 |
| JP | 2001-116750 | 4/2001 |
| JP | 2001/232245 | 8/2001 |
| WO | WO 99/03790 | 1/1999 |
| WO | WO 99/15876 | 4/1999 |
| WO | WO 99/37400 | 7/1999 |
| WO | WO 99/54730 | 10/1999 |
| WO | WO 00/035590 | 6/2000 |
| WO | WO 01/08808 | 2/2001 |
| WO | WO 03/010418 | 2/2003 |

OTHER PUBLICATIONS

Extended Abstracts (The 50th Spring Meeting, 2003); The Japan Society of Applied Physics on Related Societies, Mar. 27, 2003, p. 1299.

Proceedings of International Symposium on Bio-Trace Elements 2002, Oct. 28, 2002, pp. 37-38.

Proceedings of the 7th International Conference on Properties and Applications of Dielectric Materials, Jun. 1-5, 2003, pp. 1043-1046.

E. Litborn et al., "Parallel reactions in open chip-based nanovials with continuous compensation for solvent evaporation," *Electrophoresis*, vol. 21, Jan. 2000, pp. 91-99.

D. Shalon et al., "A DNA Microarray System for Analyzing Complex DNA Samples Using Two-color Fluorescent Probe Hybridization," *Genome Research*, vol. 6, No. 7, Jul. 1996, pp. 639-645.

* cited by examiner

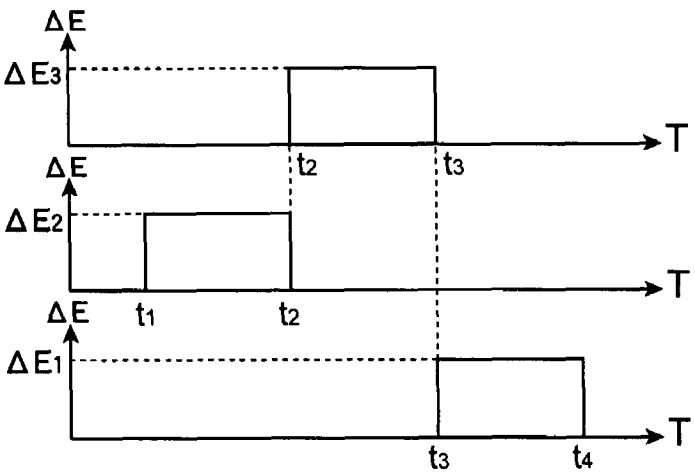
Fig.4A
Fig.4B
Fig.4C
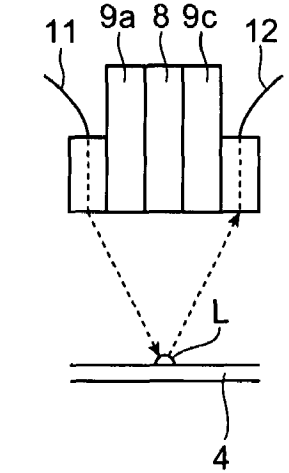
Fig.4D
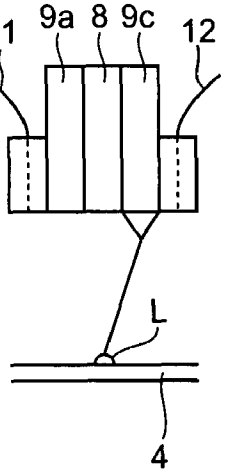
Fig.4E
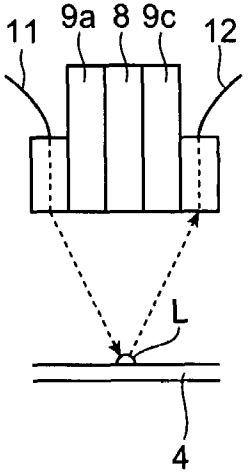
Fig.4F
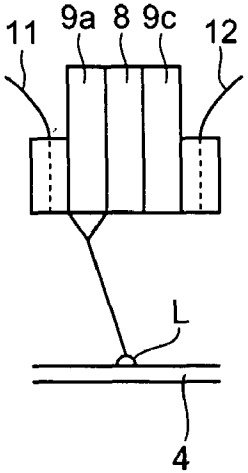
Fig.4G
Fig.4H

DROPLET FORMING METHOD FOR MIXED LIQUID AND DROPLET FORMING DEVICE, AND INK JET PRINTING METHOD AND DEVICE, AND INK JET PRINTING ELECTRODE-CARRYING NOZZLE

TECHNICAL FIELD

The present invention relates to mixture droplet forming method and apparatus, ink jet printing method and apparatus, and an ink jet printing electrode-attached nozzle.

BACKGROUND ART

Generally, an ink jet printing apparatus forms color images by stamping three primary color inks (C (cyan), M (magenta), and Y (yellow)) corresponding to three primary colors or four primary color inks (including K (black) in addition to the C, M, and Y) onto a printing object, and expresses additive colors by changes in dot density.

However, in expression of additive colors by changes in dot density, a subtle color cannot be satisfactorily expressed or a resultant image provides a sense of roughness.

As an inkjet printing apparatus solving this problem, for example, one is disclosed in Patent Document 1: Japanese Published Unexamined Patent Application No. H08-207318 as described below.

FIG. 7 is a schematic sectional view showing the ink jet printing apparatus described in the same publication. This ink jet printing apparatus 100 applies a voltage between a ring-shaped electrode 101 and an electrode plate 102 by a power supply 108, discharges a concentrated ink 104 from a liquid feed pipe 103, and forms a droplet made of the ink on a printing object 105 on the electrode plate 102. When adjusting the ink density, the concentrated ink 104 is sucked out of the liquid feed pipe 103, and simultaneously, a transparent solvent 107 is sucked out of the liquid feed pipe 106 and the concentrated ink is diluted by the transparent solvent, and the diluted droplet is discharged to form a droplet the ink density of which has been adjusted on the printing object 105.

[Patent Document 1]

Japanese Published Unexamined Patent Application No. H08-207318

DISCLOSURE OF THE INVENTION

However, the ink jet printing apparatus 100 described in the above-mentioned conventional published application has the following problem.

That is, in the ink jet printing apparatus 100, a liquid that is cut off and left on the liquid feed pipe 103 side after being discharged is a mixed liquid of the concentrated ink and the transparent solvent, and the mixed liquid remains inside the liquid feed pipe 103. Therefore, when this remaining liquid and other color ink are mixed thereafter, an unintended color is printed on the printing object. Therefore, in the method for adjusting the ink density as described above, it is difficult to realize an accurate subtle color.

Therefore, an object of the invention is to provide a mixed liquid droplet forming method and apparatus, an ink jet printing method and apparatus, and an ink jet printing electrode-attached nozzle, by which liquids to be discharged independently from each nozzle can be accurately mixed on a droplet forming object.

In order to solve the above-mentioned problem, the invention provides a mixed liquid droplet forming method comprising a first step in which a voltage is applied first between a raw material liquid housed in one of a plurality of nozzles and a flat electrode disposed opposite the nozzle to discharge the raw material liquid from the front end of the nozzle and form a droplet made of the raw material liquid on a droplet forming object disposed between the front end of the nozzle and the flat electrode, and a second step in which a voltage is applied between a raw material liquid housed in the other nozzle of the plurality of nozzles and the flat electrode to discharge the raw material liquid from the front end of the nozzle, and the droplet is mixed with the raw material liquid to form a droplet of the mixed liquid.

According to this invention, a voltage is applied first between a raw material liquid housed in one of the plurality of nozzles and the flat electrode and the raw material liquid is discharged from the front end of the nozzle to form a droplet made of the raw material liquid on a droplet forming object. At this point, due to the existence of the droplet, the equipotential line becomes convex toward the nozzle side. Therefore, when a voltage is applied between a raw material liquid housed in the other nozzle and the flat electrode, the electrical field becomes greater along the line connecting the raw material liquid and the droplet. Therefore, when the raw material liquid housed in the other nozzle is discharged, the raw material liquid is guided to this droplet, and the raw material liquids are accurately mixed within the droplet.

Preferably, in the first step, an electrode is provided on the outer circumference of at least one nozzle of the plurality of nozzles and the electrode is supplied with a potential equal to or higher than the potential of a raw material liquid inside the nozzle.

In this case, the electrical line of force concentrates immediately under the nozzle provided with the electrode, so that it becomes possible to accurately dispose the raw material liquid at a desired position on the droplet forming object. Therefore, when the raw material liquid is discharged toward the droplet forming object, the raw material liquid can be accurately mixed with the droplet on the droplet forming object. Furthermore, raw material liquids are not mixed before they are discharged but are mixed after they are discharged. Accordingly, the qualities of the raw material liquids do not change inside the nozzles. Therefore, even when a droplet is repeatedly formed on the droplet forming object, a droplet with an intended quality can be formed as one dot.

In addition, the invention provides a mixed liquid droplet forming apparatus, comprising a plurality of nozzles that house a plurality of raw material liquids and discharge the plurality of raw material liquids independently from each other, a flat electrode disposed opposite the front ends of the plurality of nozzles, and a voltage applying unit that applies a voltage between raw material liquids housed in the plurality of nozzles and the flat electrode.

According to this droplet forming apparatus, when a voltage is applied between a raw material liquid housed in one of the plurality of nozzles and the flat electrode by the voltage applying unit, the raw material liquid is discharged from the nozzle to form a droplet on the droplet forming object. At this point, due to the existence of the droplet, the equipotential line becomes convex toward the nozzle side. Therefore, when a voltage is applied between a raw material liquid housed in the other nozzle and the flat electrode, the electrical field becomes greater along the line connecting this raw material liquid and the droplet. Therefore, when the raw material liquid housed in the other nozzle is discharged, this raw material liquid is guided to this droplet and the raw material liquids are accurately mixed within this droplet.

The mixed liquid droplet forming apparatus may further comprise a control unit that controls the voltage applying apparatus so that a voltage is applied to an arbitrary raw material liquid among the plurality of raw material liquids.

Preferably, in the mixed liquid droplet forming apparatus, an electrode is provided on the outer circumference of at least one nozzle of the plurality of nozzles, and the control unit controls the voltage applying unit so that the electrode is supplied with a potential equal to or higher than the potential of the raw material liquid.

In this case, when the voltage applying unit is controlled by the control unit so as to supply a potential higher than the potential of the raw material liquid to the electrode, the electrical line of force further concentrates immediately under the nozzle. Therefore, it becomes possible to dispose the raw material liquid at a desired position on the droplet forming object. Therefore, after that, when the raw material liquid is discharged toward the droplet forming object, it can be accurately mixed with the droplet made of a raw material liquid. Furthermore, the raw material liquids are not mixed before they are discharged from the nozzles but are mixed on the droplet forming object after they are discharged, so that the qualities of the raw material liquids are not changed inside the nozzles. Therefore, a droplet with an intended quality can be formed as one dot.

According to an ink jet printing method relating to the invention, the ink jet printing method for printing a color image on a printing object by using a plurality of inks, comprises a first step in which a plurality of ink nozzles which house the plurality of inks and a dilution nozzle which houses a dilute solution that can dilute the inks are used, and the ink or the dilute solution is discharged from the ink nozzles or the dilution nozzle by an electrostatic sucking force to form a droplet on the printing object, and a second step in which the ink or the dilute solution is discharged from the ink nozzle or the dilution nozzle by an electrostatic sucking force, and the inks or the dilute solution are mixed in the droplet to form a droplet in an additive color.

According to this invention, first, a voltage is applied between the ink or the dilute solution housed in one of the ink nozzles and the dilution nozzle and the flat electrode, and the ink or dilute solution is discharged from the front end of the ink nozzle or dilution nozzle to form a droplet made of the primary color ink or dilute solution on a printing object. At this point, due to the existence of the droplet, the equipotential line becomes convex toward the nozzle side. Therefore, next, when a voltage is applied between the ink or dilute solution housed in the other nozzle and the flat electrode, the electrical field becomes great along the line connecting this ink or dilute solution and the droplet. Therefore, when the ink or dilute solution housed in the other nozzle is discharged, this liquid is guided to this droplet, and the inks or the ink and the dilute solution are accurately mixed within this droplet, whereby a droplet in an additive color is formed.

Preferably, in the first step, a droplet made of the dilute solution is formed on a printing object by discharging the dilute solution from the dilution nozzle.

In this case, when the ink is mixed with the droplet after the second step, color change of the droplet due to proceeding with the color mixture can be easily judged.

Preferably, after the second step, the method further comprises a step in which the chroma of the droplet is measured, and based on the measured chroma, the quantity of discharging the inks or the dilute solution is controlled so that the chroma of the droplet becomes a desired chroma.

In this case, a target additive color can be accurately expressed.

Preferably, in the ink jet printing method, an electrode is provided on the outer circumference of the dilution nozzle and the electrode is supplied with a potential equal to or higher than the potential of the dilute solution inside the dilution nozzle.

In this case, since the electrical line of force concentrates immediately under the dilution nozzle, the dilute solution can be accurately disposed at a desired position on a printing object. Therefore, after that, when the ink is discharged to the printing object, it can be accurately mixed with the droplet made of the dilute solution. Furthermore, the dilute solution and the ink are not mixed before they are discharged but are mixed on the printing object after they are discharged. Therefore, inks do not change in quality in the respective ink nozzles. Therefore, even when a droplet is repeatedly formed, a droplet in an intended additive color can be formed as one dot, and printing with high accuracy without distortion is realized.

According to the ink jet printing apparatus of the invention, the ink jet printing apparatus for printing a color image on a printing object by using a plurality of inks, comprises a dilution nozzle which houses a dilute solution that can dilute the inks, a flat electrode disposed opposite the front ends of the ink nozzles and the dilution nozzle, and a voltage applying unit which applies a voltage between the inks and the dilute solution and the flat electrode, wherein the plurality of ink nozzles and the dilution nozzle are disposed apart from each other.

According to this ink jet printing apparatus, when a voltage is applied between the ink or dilute solution and the flat electrode by the voltage applying unit, the ink or dilute solution is discharged from the ink nozzle or dilution nozzle to form a droplet on a printing object. At this point, due to the existence of the droplet, the equipotential line becomes convex toward the nozzle side. Therefore, when a voltage is applied between the ink or dilute solution housed in the other nozzle and the flat electrode, the electrical field becomes greater along the line connecting the ink or dilute solution and the droplet. Therefore, when the ink or dilute solution housed in the other nozzle is discharged, this liquid is guided to this droplet, and the inks or the ink and the dilute solution are accurately mixed within this droplet, whereby a droplet in an additive color is formed.

The ink jet printing apparatus may further comprise a control unit which controls the voltage applying unit so that a voltage is applied to an arbitrary liquid among the inks and the dilute solution.

Preferably, in the ink jet printing apparatus, an electrode is provided on the outer circumference of the dilution nozzle, and the control unit controls the voltage applying unit so that the electrode is supplied with a potential equal to or higher than the potential of the dilute solution.

In this case, when the voltage applying unit is controlled by the control unit so as to supply a potential equal to or higher than the potential of the dilute solution to the electrode, the electrical line of force further concentrates immediately under the dilution nozzle. Therefore, it becomes possible to dispose the dilute solution at a desired position on the printing object. Therefore, after that, when the ink is discharged toward the printing object, it can be accurately mixed with the droplet made of the dilute solution. Furthermore, the dilute solution and the ink are not mixed before they are discharged from the nozzles but are mixed on the printing object after they are discharged, so that the ink densities do not change in the ink nozzles. Therefore, a droplet in an intended additive color can be formed as one dot, whereby printing with high accuracy without distortion is realized.

Preferably, the ink jet printing apparatus further comprises an illuminating light source which illuminates a droplet formed on the printing object, and a chroma measuring unit which measures the chroma of the droplet illuminated by the illuminating light source, wherein the control unit controls the voltage applying unit based on the chroma of the droplet measured by the chroma measuring unit so that the chroma of the droplet becomes a desired chroma and adjusts the quantity of discharging the ink or the dilute solution.

In this case, a target additive color can be accurately expressed.

Furthermore, according to the invention, an ink jet printing electrode-attached nozzle which is used in an ink jet printing apparatus including a flat electrode and disposed opposite the flat electrode, comprises a nozzle housing an ink or dilute solution and an electrode provided on the outer circumference of the nozzle.

According to this ink jet printing electrode-attached nozzle, when it is used in an ink jet printing apparatus including a flat electrode, a printing object is disposed between the nozzle and the flat electrode, a voltage is applied between an ink or dilute solution housed in the nozzle and the flat electrode, and furthermore, the electrode is supplied with a potential equal to or higher than that of the ink or the dilute solution, whereby the electrical line of force further concentrates immediately under the electrode-attached nozzle, and therefore, the ink or dilute solution can be accurately disposed at a desired position on the printing object. Therefore, after that, when the ink or dilute solution is discharged to the printing object, it can be accurately mixed with the droplet on the printing object.

BRIEF DESCRIPTION OF THE DRAWINGS

FIG. 4A, FIG. 4B, and FIG. 4C are timing charts of pulse voltages in nozzles;

FIG. 4D, FIG. 4E, FIG. 4F, FIG. 4G, and FIG. 4H are views showing a series of processes for forming a droplet in an additive color, respectively;

BEST MODES FOR CARRYING OUT THE INVENTION

Hereinafter, embodiments of the invention are described in detail.

Figure 1:
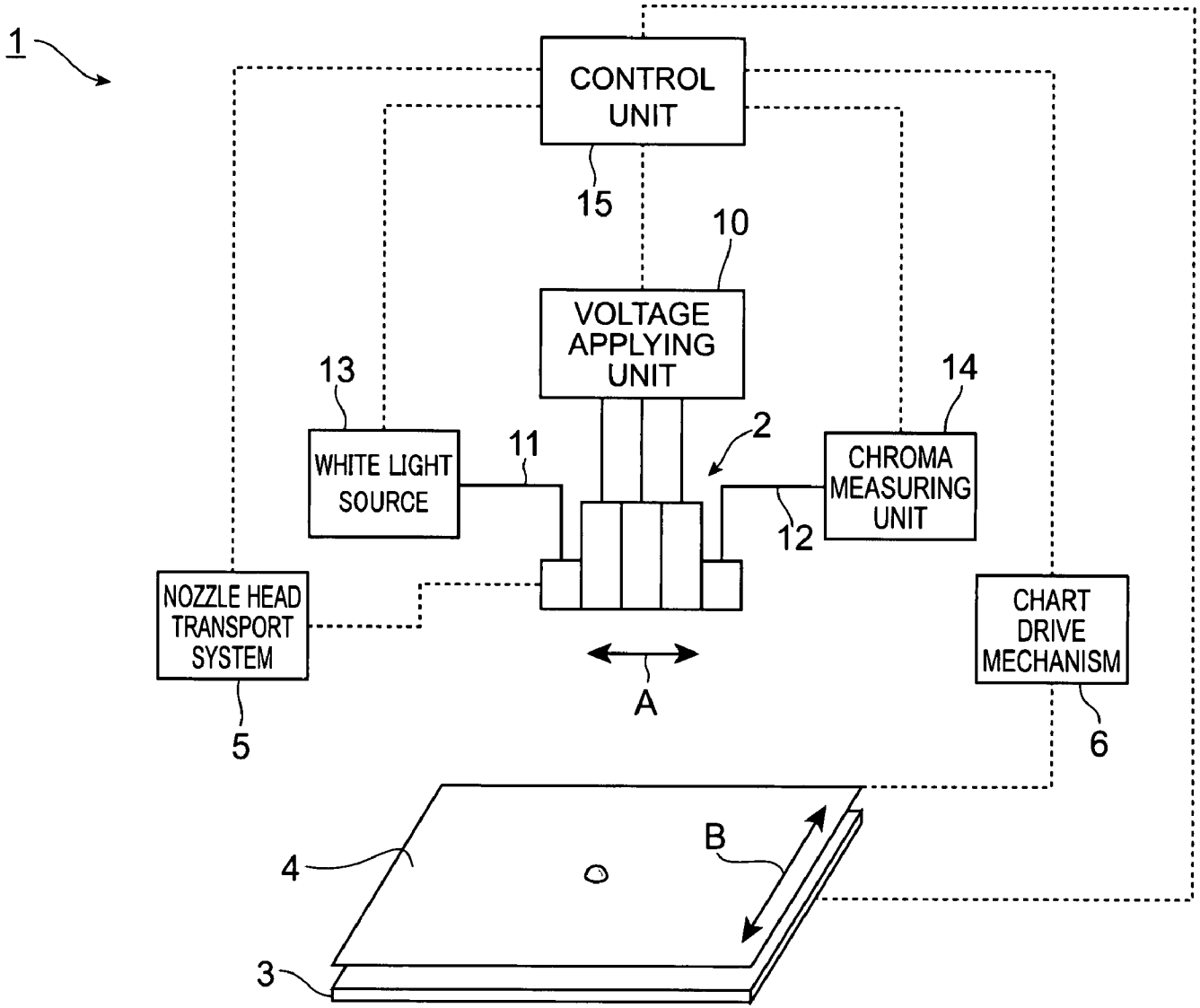
FIG. 1 is a schematic sectional view showing a main part of an embodiment of the ink jet printing apparatus of the invention.
Figure 2:
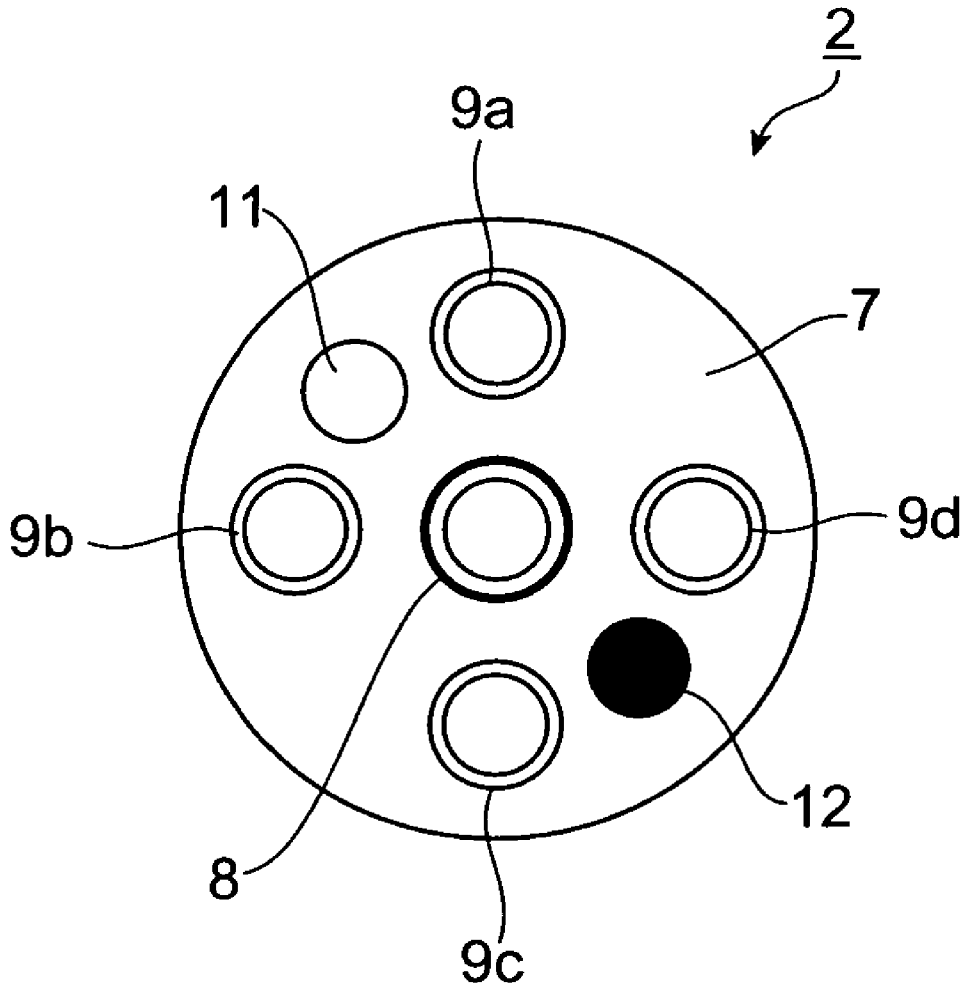
FIG. 2 is a bottom view of a nozzle head.

FIG. 1 is a schematic view showing a main part of an embodiment of the ink jet printing apparatus of the invention, and FIG. 2 is a bottom view of a nozzle head.

As shown in FIG. 1, the ink jet printing apparatus 1 of this embodiment has a nozzle head 2, and a flat electrode 3 is disposed opposite the nozzle head 2. On the flat electrode 3, a recording sheet (droplet forming object) 4 as a printing object is placed. The nozzle head 2 can be made to reciprocate in the arrow A direction of FIG. 1 by a nozzle head transport system 5, and the recording sheet 4 can be moved in the arrow B direction orthogonal to the arrow A direction by a chart drive mechanism 6.

Figure 3:
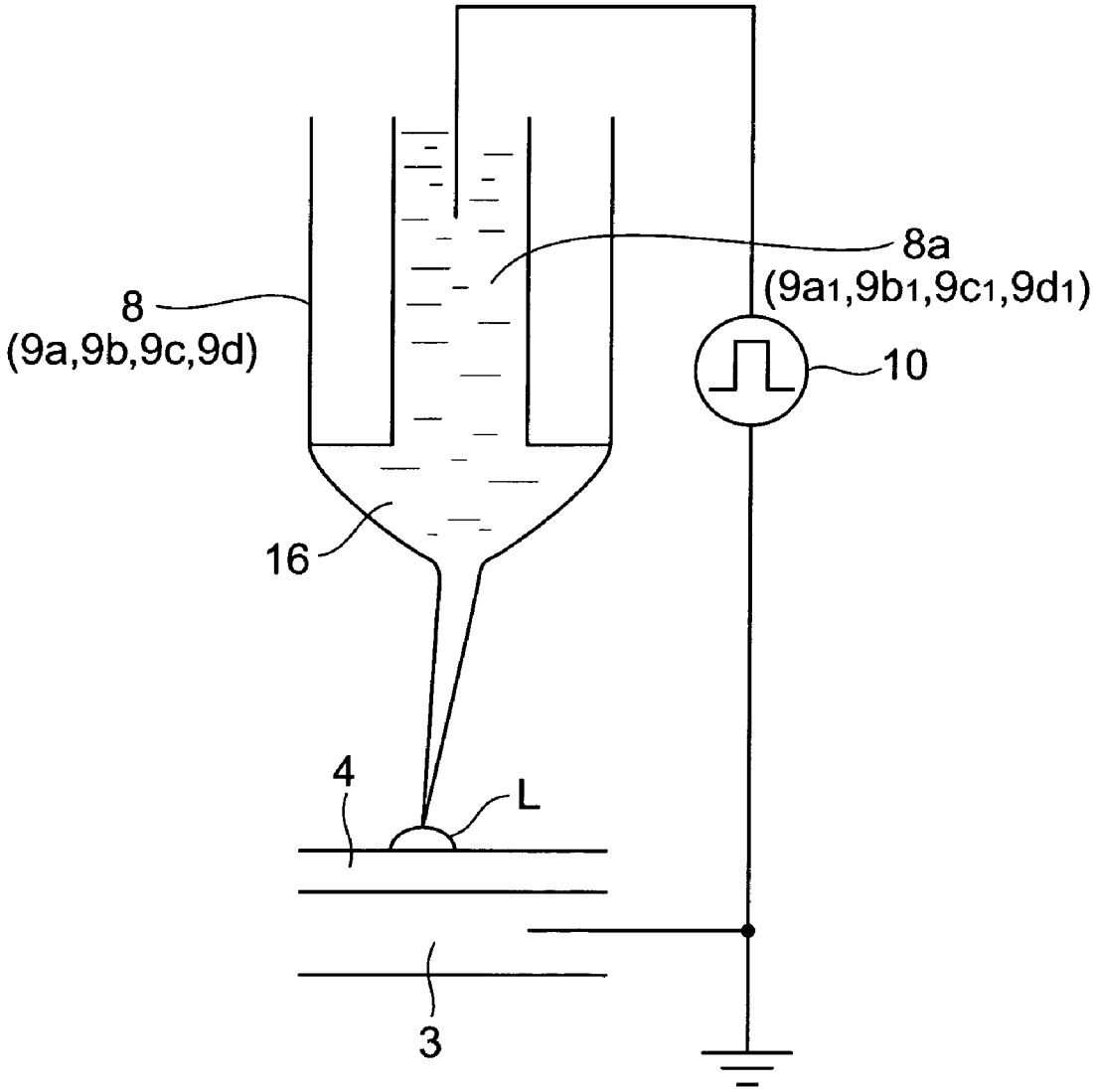
FIG. 3 is a partial sectional view of a dilution nozzle.

As shown in FIG. 2 and FIG. 3, the nozzle head 2 has a nozzle holder 7, and in the nozzle holder 7, four ink nozzles 9*a*, 9*b*, 9*c*, and 9*d* (9*a* through 9*d*) housing four primary color inks (raw material liquids) $\mathbf{9}a_1$, $\mathbf{9}b_1$, $\mathbf{9}c_1$, and $\mathbf{9}d_1$ corresponding to four primary colors are inserted and fixed. A dilution nozzle 8 and the ink nozzles 9*a* through 9*d* are made of glass in terms of dimensional stability. The four primary color inks $\mathbf{9}a_1$, $\mathbf{9}b_1$, $\mathbf{9}c_1$, and $\mathbf{9}d_1$ are C (cyan), M (magenta), Y (yellow), and K (black), and the ink nozzles 9*a* through 9*d* house the C ink $\mathbf{9}a_1$, M ink $\mathbf{9}b_1$, Y ink $\mathbf{9}c_1$, and K ink $\mathbf{9}d_1$, respectively. The dilution nozzle 8 is connected to a dilute solution supply tank (not shown), and the ink nozzles 9*a* through 9*d* are connected to ink supply tanks (not shown).

The ink nozzles 9*a* through 9*d* and the dilution nozzle 8 are disposed apart from each other. In detail, the dilution nozzle 8 is fixed to the center of the nozzle holder 7, and the ink nozzles 9*a* through 9*d* are disposed at equal intervals in a circle around the dilution nozzle 8. Disposition of the dilution nozzle 8 at the center is for discharging the dilute solution first among the primary color inks and the dilution solution when forming one dot of droplet on the recording sheet 4. Therefore, when other primary color ink is discharged first when forming one dot of droplet on the recording sheet 4, this primary color ink is disposed at the center.

Furthermore, as shown in FIG. 1, the inks and the dilute solution housed in the ink nozzles 9*a* through 9*d* and the dilution nozzle 8 are electrically connected to the flat electrode 3 via a voltage applying unit 10 that can supply pulse voltages. Therefore, by the voltage applying unit 10, between the inks or the dilute solution and the flat electrode 3, voltages are applicable.

In the nozzle holder 7, an illuminating fiber 11 and a light receiving fiber 12 are inserted and fixed at positions axisymmetrical to each other about the dilution nozzle 8 (see FIG. 2). The illuminating fiber 11 is connected to a white light source (illuminating light source) 13, and the light receiving fiber 12 is connected to a chroma measuring unit 14 (see FIG. 1). Therefore, it becomes possible to illuminate a droplet by white light from the white light source 12 through the illuminating fiber 11, and light received from the droplet through the light receiving fiber 12 is received by the chroma measuring unit 14, and the chroma of the droplet is measured based on this light.

Furthermore, the ink jet printing apparatus 1 has a control unit 15, and by the control unit 15, the nozzle head transport system 5, the chart drive mechanism 6, the voltage applying unit 10, the white light source 13, and the chroma measuring unit 14 can be controlled.

Next, an ink jet printing method using the above-described ink jet printing apparatus 1 is described with reference to FIG. 3 and FIG. 4A through FIG. 4H.

FIG. 3 is a partial sectional view of the dilution nozzle, showing a condition where a dilute solution is discharged from the dilution nozzle and a droplet is formed on the recording sheet 4. In FIG. 3, the construction of the dilution nozzle 8 is described, and the construction and function of the dilution nozzle 8 are the same as those of the ink nozzles 9*a* through 9*d*, and in this case, inside the ink nozzles 9*a* through 9*d*, inks $\mathbf{9}a_1$ through $\mathbf{9}d_1$ are housed instead of the dilute solution 8*a*.

FIG. 4A, FIG. 4B, and FIG. 4C are timing charts of pulse voltages $\Delta E_3$, $\Delta E_2$, and $\Delta E_1$ to be applied between the nozzles and the flat electrode 3, and FIG. 4D, FIG. 4E, FIG. 4F, FIG. 4G, and FIG. 4H are views showing a series of processes for forming a droplet in an additive color.

First, a pulse voltage is applied between the dilute solution and the flat electrode 3 by the voltage applying unit 10. At this point, as shown in FIG. 4B, a pulse voltage is formed by applying a voltage $\Delta E_2$ between the timings $t_1$ and $t_2$. Then, as shown in FIG. 3 and FIG. 4D, the dilute solution 8*a* is sucked out of the dilution nozzle 8 by electrostatic sucking force to form a Taylor Cone 16, and then a predetermined quantity of the dilute solution is discharged and a droplet L made of the dilute solution is formed on the recording sheet 4.

Next, a voltage is applied between the Y ink stored in the ink nozzle 9*c* and the flat electrode 3 by the voltage applying unit. At this point, as shown in FIG. 4A, between the timings $t_2$ and $t_3$, a pulse voltage is formed by applying the voltage $\Delta E_3$. At this point, due to the existence of the droplet formed on the recording sheet 4, the equipotential line is convex toward the nozzle 9*c* side, and the electrical field becomes greater along the line connecting the front end of the ink nozzle 9*c* and the droplet.

Therefore, as shown in FIG. 4E, the Y ink is sucked out of the ink nozzle 9*c* by an electrostatic sucking force and forms a Taylor Cone, and then a predetermined quantity of the Y ink is discharged toward the droplet L. The Y ink causes turbulence when it enters in the droplet, whereby the Y ink and the dilute solution are mixed accurately.

At this point, as shown in FIG. 4F, the droplet L is illuminated by white light emitted from the white light source 13 through the illuminating fiber 11, and light emitted from the droplet L is received by the chroma measuring unit 14 through the light receiving fiber 12. Then, based on the chroma measured by the chroma measuring unit 14, an addition quantity of the Y ink or the dilute solution is adjusted so that the chroma of the droplet L becomes a desired chroma. In detail, this addition quantity is adjusted by the pulse period of the pulse voltage outputted from the voltage applying unit 10.

Next, a voltage is applied between the C ink housed in the ink nozzle 9*a* and the flat electrode 3 by the voltage applying unit 10. At this point, as shown in FIG. 4C, between the timings $t_3$ and $t_4$, a pulse voltage is formed by applying the voltage $\Delta E_1$. At this point, due to the existence of the droplet L formed on the recording sheet 4, the equipotential line is convex toward the ink nozzle 9*a* side, and therefore, the electrical field becomes greater along the line connecting the front end of the ink nozzle 9*a* and the droplet L. Therefore, as shown in FIG. 4G, the C ink is sucked out of the ink nozzle 9*a* by an electrostatic sucking force and forms a Taylor Cone, and then a predetermined quantity of the C ink is discharged toward the droplet L. The C ink causes turbulence when it enters the inside of the droplet L, whereby the C ink and the dilute solution are accurately mixed.

At this point, as shown in FIG. 4H, the droplet L is illuminated by white light emitted from the white light source 13 through the illuminating fiber 11, and light emitted from the droplet L is received by the chroma measuring unit 14 through the light receiving fiber 12. Then, in the same manner as described above, based on the chroma measured by the chroma measuring unit 14, the addition quantity of the C ink or the dilute solution is adjusted so that the chroma of the droplet L becomes a desired chroma.

Thereafter, the M ink and the K ink are injected into the droplet L as appropriate to form a droplet L in an additive color. The method for injecting the M ink and the K ink is the same as that for the Y ink. When forming a droplet L in an additive color, it is preferable that the color is gradually made darker from a light color, and a color with a target chroma is finally reached. Thereby, judgement on changes in color by chroma measurement can be made easily.

A droplet L in an additive color is thus formed on the recording sheet 4. This droplet L in the additive color is formed by mixture of primary color inks, however, mixture of primary color inks is not carried out before the inks are discharged from the nozzles, but is carried out after they are discharged. Therefore, the densities of the primary color inks housed in the ink nozzles 9*a* through 9*d* are always maintained constant. Therefore, even when the ink jet printing apparatus 1 is repeatedly used, a droplet L formed on the recording sheet 4 can be accurately provided with an intended additive color.

After forming a droplet, the recording sheet 4 is moved in the arrow B direction of FIG. 1 by the chart transport system 6 or the nozzle head 2 is moved in the arrow A direction of FIG. 1 by the nozzle head transport system 5, a droplet is formed in the same manner as described above, and this operation is repeated, whereby a color image using real colors instead of false colors can be formed. The operations of the above-described nozzle head transport system 5, the chart transport system 6, the voltage applying unit 10, the white light source 13, and the chroma measuring unit 14 may be all controlled by the control unit 15.

Herein, for providing a droplet L with an intended additive color more accurately, it is preferable that the degree of color mixture of the droplet L is judged every time each ink is injected into the droplet L.

In detail, the following operation is carried out for judging the degree of color mixture of the droplet L.

Namely, the droplet L is illuminated by white light first, and the chroma of the droplet L is measured by using the chroma measuring unit 14. Next, the measured chroma is converted and a brightness index L* according to the CIELAB color system and chroma coordinates a* and b* are calculated.

However, in this case, previous to color mixture, it is necessary that the mixture ratio of the primary color inks for realizing the target additive color and the values of L*, a* and b* of the primary color inks according to the ratio are prepared based on the data of the absorption spectra of the primary color inks.

Herein, an example of the process realizing the target additive color by judging the degree of color mixture of the droplet based on the measured chroma is described.

Figure 5:
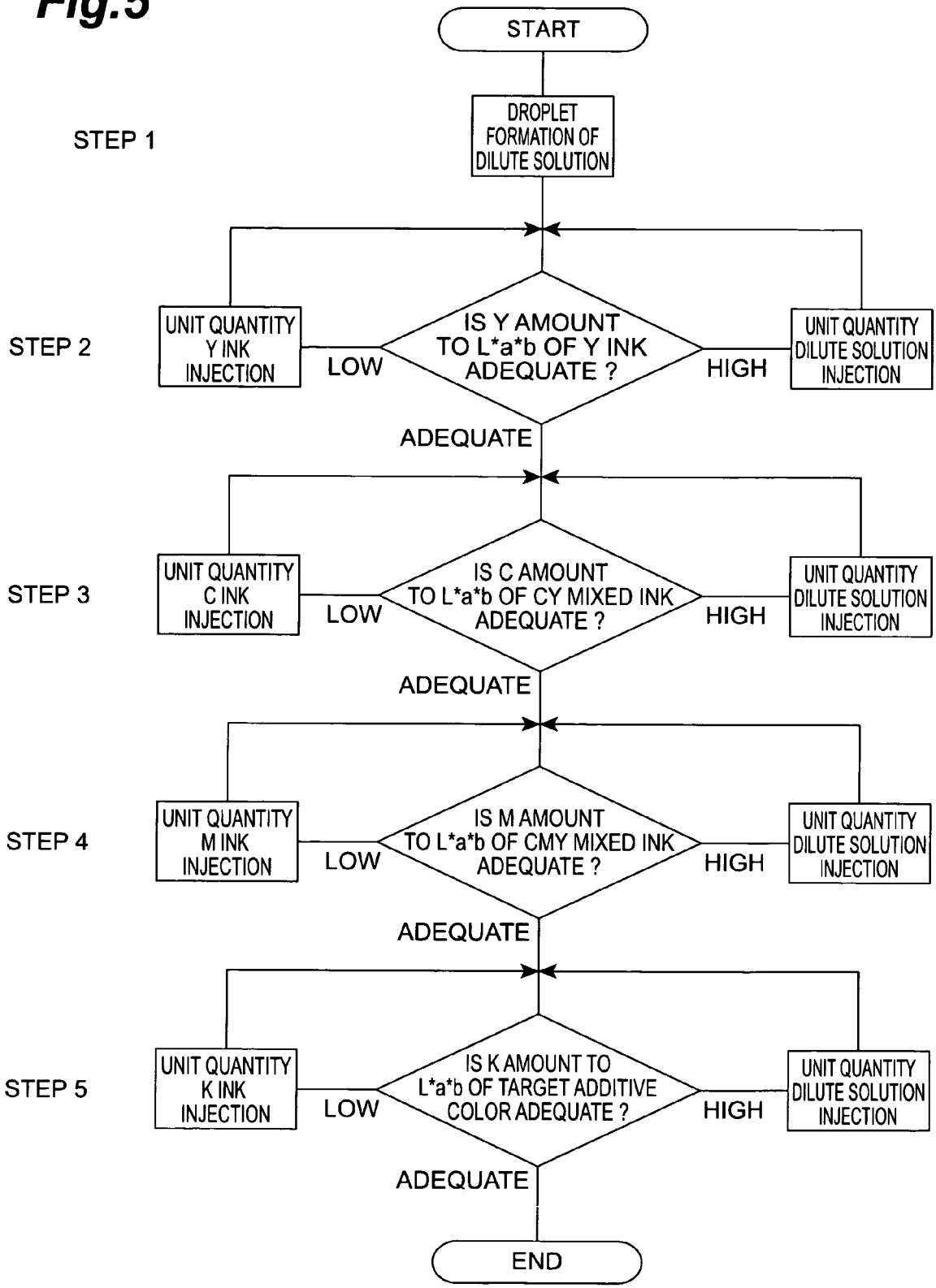
FIG. 5 is a flowchart showing processes for accurately realizing an intended additive color.

FIG. 5 is a flowchart for realizing the target additive color. As shown in FIG. 5, first, a droplet L made of a dilute solution is formed on the recording sheet 4 (Step 1).

Next, by setting the values of L*, a*, b* with respect to the target additive color as judgement criteria, it is judged whether the degree of mixture of the Y ink is high or low. If the degree is low, a unit quantity of the Y ink is added, and if the degree is high, a unit quantity of the dilute solution is added (Step 2). Herein, the unit quantity means the quantity of ink or dilute solution to be discharged when a voltage of one pulse is applied between the ink or dilute solution and the flat electrode 3.

Next, the values of L*, a*, and b* of the C-Y mixed ink with respect to the target additive color are set as judgement criteria, and it is judged whether the degree of mixture of the C ink is high or low. If it is low, a unit quantity of the C ink is added, and if it is high, a unit quantity of the dilute solution is added (Step 3).

Next, the values of L*, a* and b* of C-M-Y mixed ink with respect to the target additive color are set as judgement criteria, and it is judged whether the degree of mixture of the M ink is high or low. If it is low, a unit quantity of the M ink is added, and if it is high, a unit quantity of the dilute solution is added (Step 4).

Last, accurate values of L*, a*, and b* with respect to the target additive color are set as judgement criteria, and it is judged whether the degree of mixture of the K ink is high or low. If it is low, a unit quantity of the K ink is added, and if it is high, a unit quantity of the dilute solution is added (Step 5).

Thus, the chroma of the droplet is measured every time an ink is injected into the droplet, and color mixture is carried out while the degrees of mixture of colors are judged, whereby the droplet L can be accurately provided with the target additive color.

Figure 6:
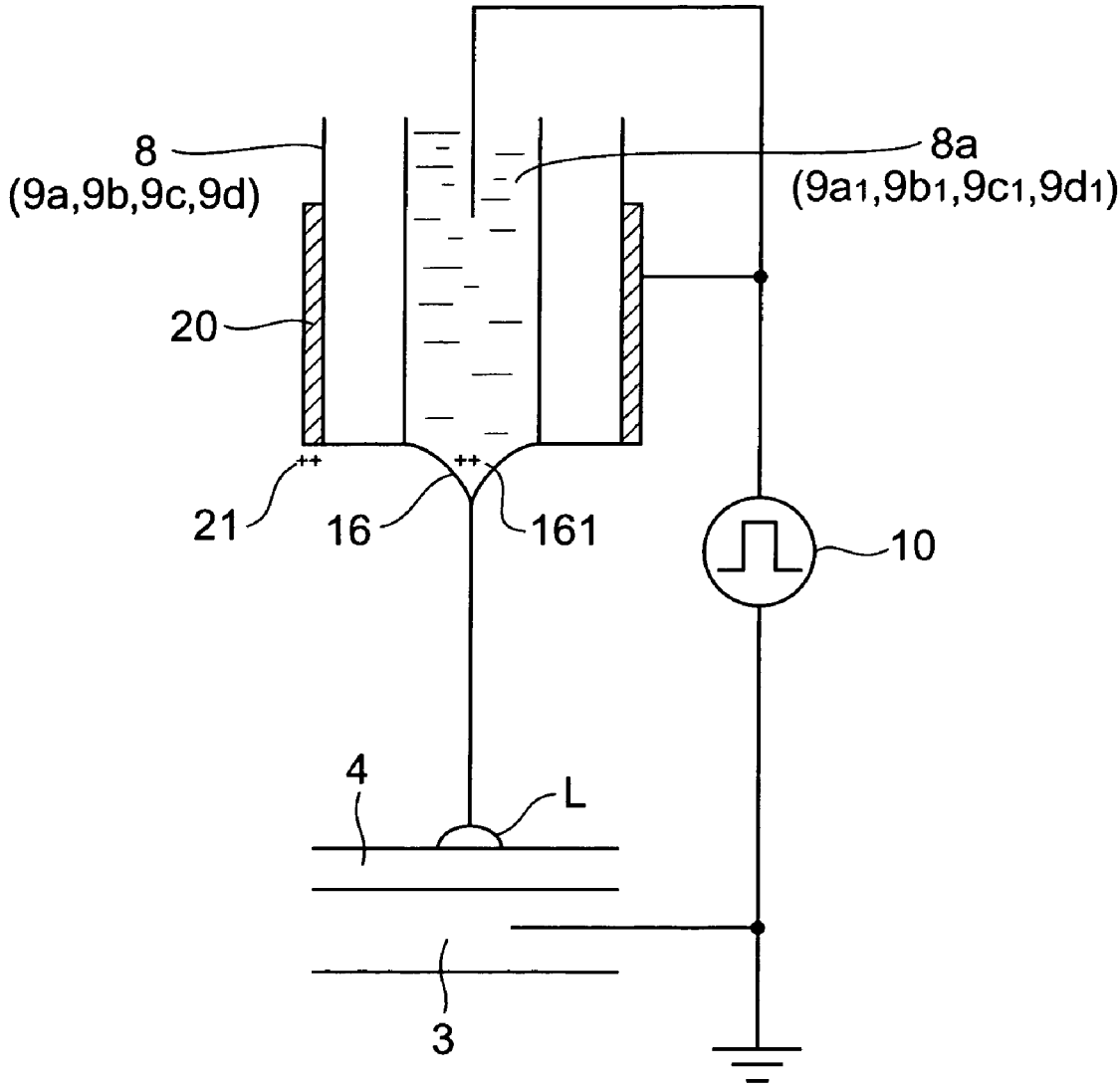
FIG. 6 is a schematic sectional view showing a main part of another embodiment of the ink jet printing apparatus of the invention.
Figure 7:
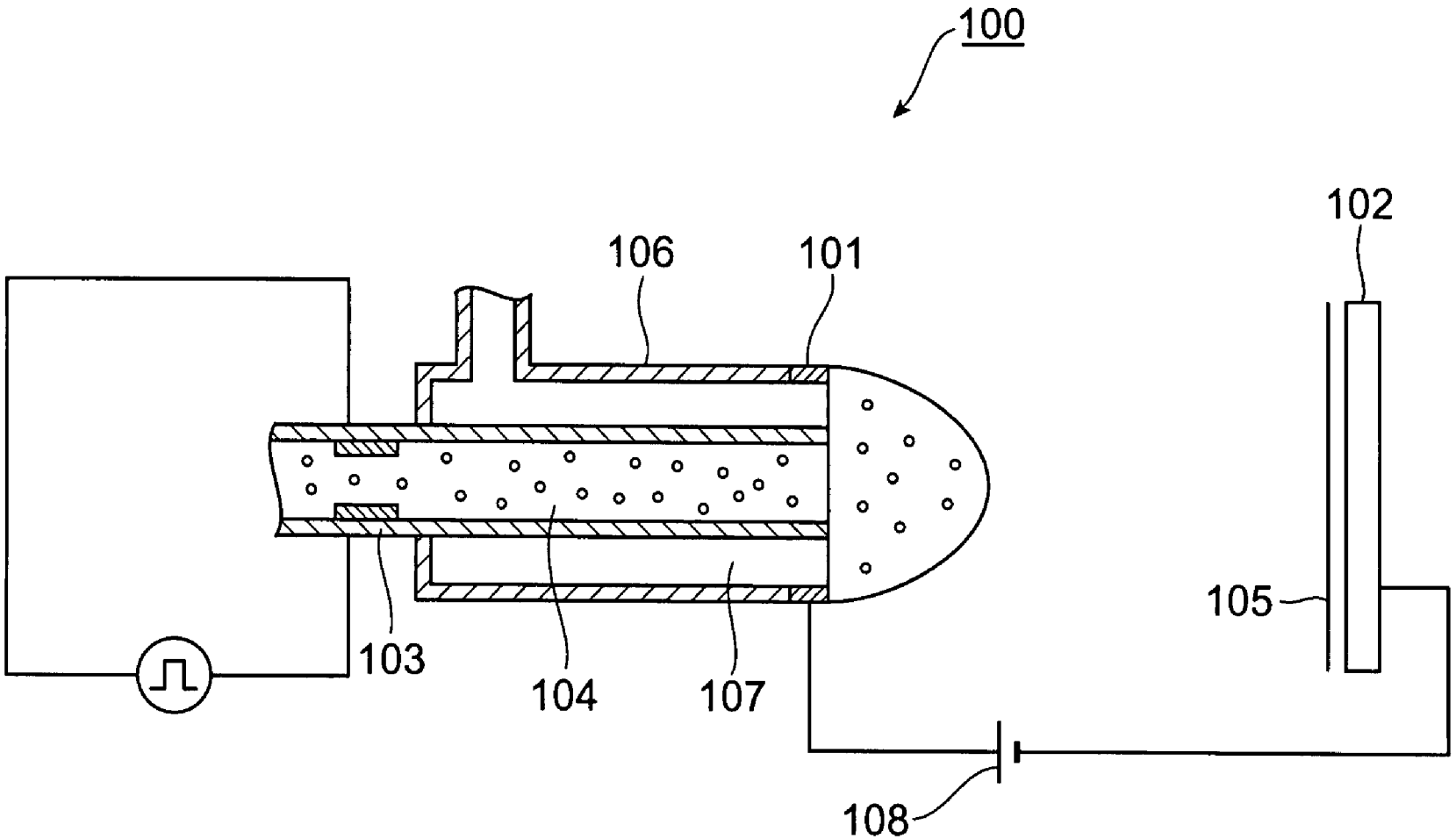
FIG. 7 is a schematic sectional view showing an example of a conventional ink jet printing apparatus.

Next, a second embodiment of the ink jet printing apparatus of the invention is described with reference to FIG. 6. In FIG. 6, components identical or equivalent to those of the first embodiment are attached with the same symbols and description thereof is omitted.

As shown in FIG. 6, the ink jet printing apparatus of this embodiment is different from the ink jet printing apparatus 1 of the first embodiment in that the dilution nozzle (electrode-attached nozzle) that has an electrode 20 on its outer circumference is provided.

Herein, the material forming the electrode 20 is not especially limited as long as it has conductivity, however, such a material is preferably gold or platinum in terms of corrosion proof. The electrode 20 is formed by, for example, depositing the material on the front end of the dilution nozzle 8.

In the ink jet printing apparatus of this embodiment, to form the droplet L, the same voltage as the pulse voltage applied between, for example, the dilute solution 8*a* and the flat electrode 3 is applied between the electrode and the flat electrode 3.

Then, the electrostatic inductive charge 21 appearing at the front end of the electrode 20 biases the charge distribution of the electrostatic inductive charge 161 on the surface of the dilute solution so that the distribution becomes highest at the center of the nozzle, so that a great electrostatic force acts on the portion with the high charge density, that is, between the center of the dilute solution surface and the flat electrode 3. As a result, the Taylor Cone 16 stays within the inner diameter portion of the nozzle end face, and the form thereof is deformed to be more acute. This is a result of concentration of the electrical line of force on the nozzle center portion. Therefore, the position where the droplet L is formed can be extremely stabilized. In other words, the droplet L can be accurately formed at a desired position on the recording sheet 4.

After the droplet L is formed on the recording sheet 4, since primary color inks can be accurately injected to the droplet L in the ink jet printing apparatus of this embodiment, a droplet L in an additive color can be accurately formed at a desired position. At this point, in the droplet L, a plurality of droplets do not express one additive color, but the droplet itself, that is, one dot expresses an additive color. Therefore, by the ink jet printing apparatus of this embodiment, a color image with high accuracy without distortion can be printed.

Furthermore, according to the ink jet printing apparatus of this embodiment, although the Taylor Cone 16 is formed, it stays within the inner diameter portion of the nozzle, the front end portion thereof becomes acute, and liquid can be quickly cut off when it is discharged. Therefore, the distance between the dilute solution 8*a* and the flat electrode 3 can be shortened, and driving is carried out even by a comparatively small voltage. This effect eliminates the possibility of discharge between the dilute solution 8*a* and the flat electrode 3, and improves the reliability of the ink jet printing apparatus. Furthermore, by shortening the distance between the nozzle front end and the flat electrode 3, downsizing of the ink jet printing apparatus also becomes possible.

Furthermore, by the ink jet printing apparatus of this embodiment, in addition to the above-described effect, on-demand printing is also possible. Therefore, the ink jet printing apparatus of this embodiment is extremely effective as a micro printing apparatus of anticounterfeit printing technology.

In the above-described embodiment, the same voltage as the pulse voltage applied between the dilute solution and the flat electrode 3 is applied between the electrode 20 and the flat electrode when forming the droplet, however, it is preferable that a voltage greater than the pulse voltage applied between the dilute solution and the flat electrode 3 is applied between the electrode 20 and the flat electrode 3. In this case, the electrostatic inductive charge 21 appearing at the front end of the electrode 20 biases the charge distribution of the electrostatic inductive charge 161 on the dilute solution surface so that the distribution becomes highest at the nozzle center portion, so that a great electrostatic force acts on the portion with the high charge density, that is, between the center portion of the dilute solution surface and the flat electrode 3. Therefore, the position where the droplet is formed can be further stabilized, and a color image with high accuracy without distortion can be printed.

In the above-described embodiment, the electrode 20 is provided for only the dilution nozzle 8, however, it is preferable that the electrode 20 is also provided for the ink nozzles 9*a* through 9*d*. In this case, the outer circumferences of the front ends of the ink nozzles 9*a* through 9*d* are provided with electrodes 20, and the construction and function thereof are those obtained by substituting the dilution nozzle 8 shown in FIG. 6 with the ink nozzles 9*a* through 9*d*. With these ink nozzles 9*a* through 9*d*, when the primary color inks $\mathbf{9}a_1$ through $\mathbf{9}d_1$ are discharged, smaller unit quantities of the primary color inks made of liquids that can be quickly cut off can be injected into the droplet L.

The invention is not limited to the above-described first and second embodiments. For example, the first and second embodiments relate to ink jet printing apparatuses and use primary color inks or dilute solution as raw material liquids, however, as raw material liquids, the mixed liquid droplet forming apparatus of this embodiment can also use a conductive liquid (for example, a silver paste or mercury) instead of the primary color inks and dilute solution. In this case, liquids independently discharged from the respective nozzles can be accurately mixed on a droplet forming object. Furthermore, this conductive liquid droplet forming apparatus functions as an apparatus for forming fine two-dimensional electrical circuits (electrical wires, resistors, capacitors, reactance, and so on). As the raw material liquid, an insulating liquid such as silicon oil or machine oil, etc., may be used instead of the conductive liquid.

As described above, according to the mixed liquid droplet forming method and forming apparatus of the invention, liquids independently discharged from the nozzles can be accurately mixed on a droplet forming object.

Furthermore, according to the ink jet printing method and apparatus of the invention, primary color inks or dilute solution independently discharged from the nozzles can be accurately mixed on a printing object and a droplet in an intended additive color can be accurately formed.

Furthermore, according to the ink jet printing electrode-attached nozzle of the invention, when it is an ink jet printing apparatus including a flat electrode, a printing object is disposed between the nozzle and the flat electrode, and a voltage is applied between an ink or dilute solution housed in the nozzle and the electrode and a potential higher than that of the ink or the dilute solution is supplied to the electrode, whereby the electrical line of force further concentrates immediately under the electrode-attached nozzle, so that it becomes possible to accurately dispose the ink or dilute solution at a desired position on the printing object. Therefore, when the ink or dilute solution is discharged to the printing object thereafter, it can be accurately mixed with the droplet on the printing object.

Furthermore, in the chemical reaction in a liquid phase as a reacting field, when carrying out reaction development and reaction analysis for composing a desired product from a plurality of raw material substances, for example, it is required that density dependency of each raw material substance with respect to the yield of a desired product in probable reaction, density dependency of a catalyst (including enzymes), effects when using a different catalyst, and effects when using a different solvent are grasped and the reaction conditions are optimized.

In this case, for example, as in the case of drug screening in pharmaceutical development, enormous samples must be analyzed by changing the reaction conditions. Therefore, in terms of operation efficiency improvement and cost reduction, technical development has been considered for arranging many droplets of mixed liquids with desired ingredient compositions orderly and quickly on predetermined spots on a substrate as small quantities of droplets.

In detail, technical development has been examined for a method in which raw material liquids containing raw material substances and substances relating to reaction of the catalyst or the like are prepared individually, and at the time of analysis, droplets of these are mixed in this situation at a predetermined volume ratio to instantaneously form droplets of mixed liquids with different ingredient compositions.

For example, Japanese Published Unexamined Patent Application No. 2001-116750 discloses a method for manufacturing a reactive chip including a substrate on which substances (DNA fragments, cDNA, polypeptides, oligonucleotides, etc.) to be used as probes for DNA analysis and the like are fixed by supplying predetermined quantities of reactive substances (nucleotides, cDNA, DNA fragments, enzymes, antigens, antibodies, epitopes, or proteins, etc.) to predetermined spots on the substrate at a high speed by using a plurality of ink jet nozzles and fixing these to the spot surfaces, and proposes a method for producing the reactive substances by supplying raw materials of the reactive substances instead of the reactive substances on predetermined spots on the substrate by using the similar method.

Namely, the raw material liquids to be housed in the above-mentioned nozzles may be reactive substances (nucleotides, cDNA, DNA fragments, enzymes, antigens, antibodies, epitopes or proteins, etc.) in place of the inks.

In other words, the above-mentioned raw material nozzles 9*a*, 9*b*, 9*c*, and 9*d* are electrode-attached nozzles characterized by being provided with electrodes on the outer circumferences of the front ends of the nozzles each housing a single raw material liquid, and by separately providing a dilution nozzle 8 housing only a dilute solution apart from the raw material nozzles, the raw material liquids and the dilute solution are discharged by a voltage applied between the electrodes 20 and the flat electrode 3 and mixed on a droplet forming object.

INDUSTRIAL APPLICABILITY

The present invention can be used for a mixed liquid droplet forming method and apparatus, an ink jet printing method and apparatus, and an ink jet printing electrode-attached nozzle.

The invention claimed is:

1. A mixed liquid droplet forming method comprising:

a first step in which a voltage is applied first between a first raw material liquid housed in one of a plurality of nozzles and a flat electrode disposed opposite the nozzle to discharge the first raw material liquid from the front end of the nozzle and form a droplet made of the first raw material liquid on a droplet forming object disposed between the front end of the nozzle and the flat electrode; and a second step in which a voltage is applied between a second raw material liquid housed in the other nozzle of the plurality of nozzles and the flat electrode to discharge the second raw material liquid from the front end of the nozzle, and the droplet is mixed with the second raw material liquid to form a droplet of the mixed liquid.

2. The mixed liquid droplet forming method according to claim 1, wherein in the first step, an electrode is provided on the outer circumference of at least one nozzle of the plurality of nozzles and the electrode is supplied with a potential equal to or higher than a potential of a raw material liquid inside the nozzle.

3. A mixed liquid droplet forming apparatus, comprising:

a plurality of nozzles that house a plurality of raw material liquids and discharge the plurality of raw material liquids independently from each other;

a flat electrode disposed opposite the front ends of the plurality of nozzles; and a voltage applying unit that applies a voltage between raw material liquids housed in the plurality of nozzles and the flat electrode.

4. The mixed liquid droplet forming apparatus according to claim 3, further comprising a control unit that controls the voltage applying unit so that the voltage is applied to an arbitrary raw material liquid among the plurality of raw material liquids.

5. A mixed liquid droplet forming apparatus, comprising:

a plurality of nozzles that house a plurality of raw material liquids and discharge the plurality of raw material liquids independently from each other;

a flat electrode disposed opposite the front ends of the plurality of nozzles;

a voltage applying unit that applies a voltage between raw material liquids housed in the plurality of nozzles and the flat electrode; and a control unit that controls the voltage applying unit so that a voltage is applied to an arbitrary raw material liquid among the plurality of raw material liquids, wherein an electrode is provided on the outer circumference of at least one nozzle of the plurality of nozzles, and the control unit controls the voltage applying unit so that the electrode is supplied with a potential equal to or higher than a potential of the raw material liquid.

6. An ink jet printing method for printing a color image on a printing object by using a plurality of inks, comprising:

a first step in which a plurality of ink nozzles which house the plurality of inks and a dilution nozzle which houses a dilute solution that can dilute the inks are used, and the ink or the dilute solution is discharged from the ink nozzle or the dilution nozzle by an electrostatic sucking force to form a droplet on the printing object; and a second step in which the ink or the dilute solution is discharged from the ink nozzle or the dilution nozzle by an electrostatic sucking force, and the inks or the dilute solution are mixed in the droplet to form a droplet in an additive color.

7. The ink jet printing method according to claim 6, wherein in the first step, a droplet made of the dilute solution is formed on a printing object by discharging the dilute solution from the dilution nozzle.

8. An ink jet printing method for printing a color image on a printing object by using a plurality of inks, comprising:

a first step in which a plurality of ink nozzles which house the plurality of inks and a dilution nozzle which houses a dilute solution that can dilute the inks are used, and the ink or the dilute solution is discharged from the ink nozzle or the dilution nozzle by an electrostatic sucking force to form a droplet on the printing object;

a second step in which the ink or the dilute solution is discharged from the ink nozzle or the dilution nozzle by an electrostatic sucking force, and the inks or the dilute solution are mixed in the droplet to form a droplet in an additive color, and after the second step, a step in which the chroma of the droplet is measured, and based on the measured chroma, the quantity of discharging the ink or the dilute solution is controlled so that the chroma of the droplet becomes a desired chroma.

9. An ink jet printing method for printing a color image on a printing object by using a plurality of inks, comprising:

a first step in which a plurality of ink nozzles which house the plurality of inks and a dilution nozzle which houses a dilute solution that can dilute the inks are used, and the ink or the dilute solution is discharged from the ink nozzle or the dilution nozzle by an electrostatic sucking force to form a droplet on the printing object; and a second step in which the ink or the dilute solution is discharged from the ink nozzle or the dilution nozzle by an electrostatic sucking force, and the inks or thedilute solution are mixed in the droplet to form a droplet in an additive color, wherein in the first step, a droplet made of the dilute solution is formed on a printing object by discharging the dilute solution from the dilution nozzle, and wherein in the first step, an electrode is provided on the outer circumference of the dilution nozzle and the electrode is supplied with a potential equal to or higher than a potential of the dilute solution inside the dilution nozzle.

10. An ink jet printing apparatus for printing a color image on a printing object by using a plurality of inks, comprising:

a plurality of ink nozzles which house the plurality of inks, respectively;

a dilution nozzle which houses a dilute solution that can dilute the inks;

a flat electrode disposed opposite the front ends of the ink nozzles and the dilution nozzle; and a voltage applying unit which applies a voltage between the inks and the dilute solution and the flat electrode, wherein the plurality of ink nozzles and the dilution nozzle are disposed apart from each other.

11. The ink jet printing apparatus according to claim 10, further comprising a control unit which controls the voltage applying unit so that a voltage is applied to an arbitrary liquid among the inks and the dilute solution.

12. An ink jet printing apparatus for printing a color image on a printing object by using a plurality of inks, comprising:

a plurality of ink nozzles which house the plurality of inks, respectively;

a dilution nozzle which houses a dilute solution that can dilute the inks;

a flat electrode disposed opposite the front ends of the ink nozzles and the dilution nozzle;

a voltage applying unit which applies a voltage between the inks and the dilute solution and the flat electrode, wherein the plurality of ink nozzles and the dilution nozzle are disposed apart from each other; and a control unit which controls the voltage applying unit so that a voltage is applied to an arbitrary liquid among the inks and the dilute solution, wherein an electrode is provided on the outer circumference of the dilution nozzle, and the control unit controls the voltage applying unit so that the electrode is supplied with a potential equal to or higher than the potential of the dilute solution.

13. An ink jet printing apparatus for printing a color image on a printing object by using a plurality of inks, comprising:

a plurality of ink nozzles which house the plurality of inks, respectively;

a dilution nozzle which houses a dilute solution that can dilute the inks;

a flat electrode disposed opposite the front ends of the ink nozzles and the dilution nozzle; and a voltage applying unit which applies a voltage between the inks and the dilute solution and the flat electrode, wherein the plurality of ink nozzles and the dilution nozzle are disposed apart from each other;

a control unit which controls the voltage applying unit so that a voltage is applied to an arbitrary liquid among the inks and the dilute solution, an illuminating light source which illuminates a droplet formed on the printing object; and a chroma measuring unit which measures the chroma of the droplet illuminated by the illuminating light source, wherein the control unit controls the voltage applying unit based on the chroma of the droplet measured by the chroma measuring unit so that the chroma of the droplet becomes a desired chroma and adjusts the quantity of discharging the ink or the dilute solution.

* * * * *